United States Patent [19]

Masuda

[11] Patent Number: 4,802,292

[45] Date of Patent: Feb. 7, 1989

[54] CONTINUOUS MINING DEVICE FOR CRUST DEPOSITS, ETC. AND CONTINUOUS LINE BUCKET METHOD WITH TURNING MOVEMENT

[75] Inventor: Yoshio Masuda, Kanagawa, Japan

[73] Assignee: Hideaki Fukada, Tokyo, Japan; a part interest

[21] Appl. No.: 12,453

[22] Filed: Feb. 9, 1987

[30] Foreign Application Priority Data

Feb. 13, 1986 [JP] Japan ..... 61-27933

[51] Int. Cl.[4] ..... E02F 3/14

[52] U.S. Cl. ..... 37/69; 37/195; 37/DIG. 8

[58] Field of Search ..... 299/9; 37/54, 69, 83, 37/DIG. 8, 195

[56] References Cited

U.S. PATENT DOCUMENTS

| | | | |
|---|---|---|---|
| 1,315,228 | 9/1919 | Ludlum et al. | 299/9 |
| 3,672,079 | 6/1972 | Masuda et al. | 37/69 |
| 3,968,579 | 7/1976 | Rossfelder | 299/9 X |
| 4,226,035 | 10/1980 | Saito | 37/69 |

FOREIGN PATENT DOCUMENTS

| | | | |
|---|---|---|---|
| 225973 | 10/1985 | Japan . | |
| 1239178 | 7/1971 | United Kingdom | 37/69 |
| 1428081 | 3/1976 | United Kingdom . | |

OTHER PUBLICATIONS

"Cobalt-Rich Crust Mining by Continuous Line Bucket"—Oceans 87 International Conference held by Marine Tech. Soc. on 9/28/1987 & 10/1/1987.

"Model Test of Turning Continuous Line Bucket", by Masuda, 8/1987.

*Primary Examiner*—Jerome W. Massie
*Assistant Examiner*—David J. Bagnell
*Attorney, Agent, or Firm*—Cushman, Darby & Cushman

[57] ABSTRACT

Apparatus suitable for mining cobalt rich crust deposits existing on or near the surfaces of seamounts on the bottom of the sea uses a continuous line bucket method with a mining ship which mounts said device thereon. The device is equipped at optimal locations with an endless rope, a driving mechanism, a large number of dredge buckets, a guide wheel on paying out side, a guide wheel on pulling up side and devices for maneuvering the ship. The endless rope is paid out from the ship with the large number of dredge buckets attached thereon to dredge off and mine the crusts while the mining ship is steered ahead. The method is characterized in that as the rope line on the paying out side constantly traces an arc while that on the pulling up side traces substantially a straight line, they can be kept apart from each other, and that a strong tension can be applied on the ship from the pulling up side to allow the ship to overcome the resistance and to turn smoothly by positioning a guide wheel on the pulling up side at an optimal location near the center of gravity of the ship.

7 Claims, 5 Drawing Sheets

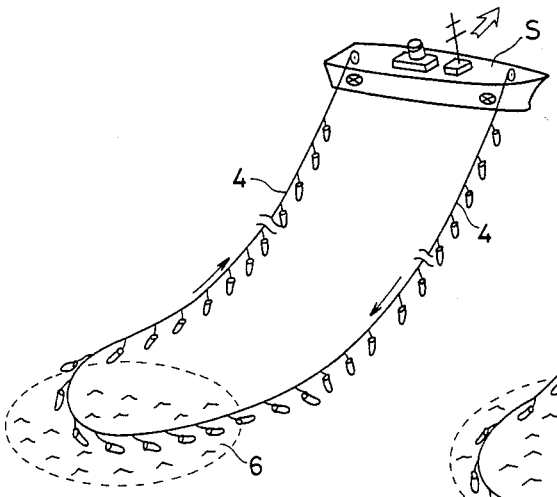
FIG. 6
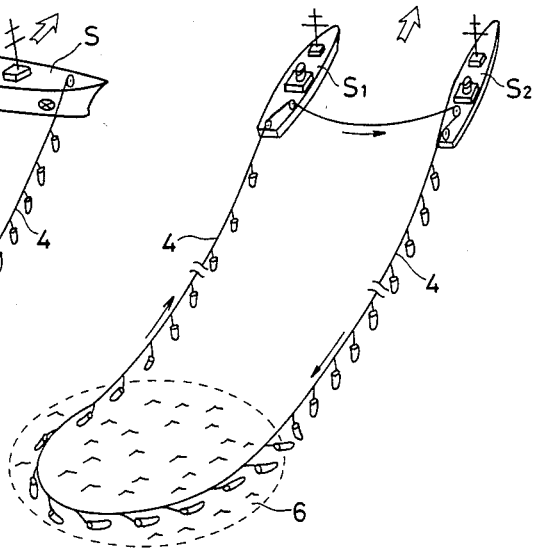
FIG. 7
FIG. 8
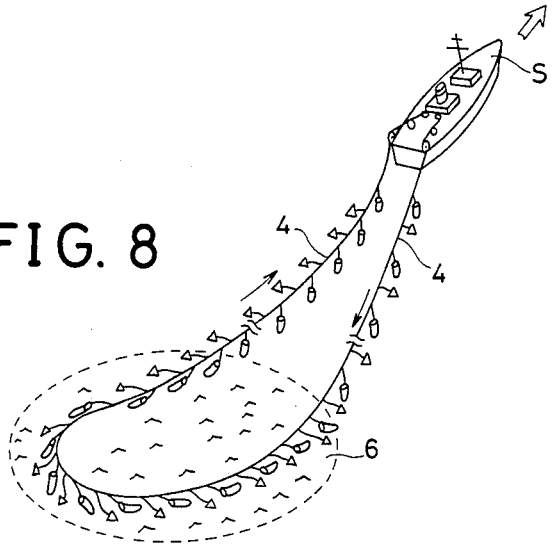

CONTINUOUS MINING DEVICE FOR CRUST DEPOSITS, ETC. AND CONTINUOUS LINE BUCKET METHOD WITH TURNING MOVEMENT

CROSS REFERENCES TO RELATED APPLICATIONS

The inventors of the present application have long been engaged in the research and development of the continuous line bucket mining method. They filed for patent application for the following inventions and have endeavored in the development and practical application thereof: U.S. Pat. No. 3,672,079 (filed Apr. 22, 1970), British Pat. No. 1,239,178 (filed Apr. 18, 1970) and British Pat. No. 1,428,081 (filed Jan. 11, 1973).

BACKGROUND OF THE INVENTION (a) Field of the Invention

This invention relates to a continuous mining device for cobalt rich crust deposits existing on relatively narrow sea-bottoms of the seamounts and a method of operating a mining ship which mounts said device. This invention further relates to an improved continuous mining device for mineral resources existing in the deep sea-bottom such as phosphorate ore or manganese nodule and a mining method using the device.

Crust deposit is a type of deep sea manganese oxide metallic deposit but is basically different from manganese nodule deposits existing on the surface of 4,000 to 6,000 m deep sea bottoms which have been the major subject of research for the last fifteen years.

Crust deposits lie on the sea bottoms of a less depth than the manganese nodule deposits and are distributed on slopes of seamounts or flat terraces like the sea bottoms of 800 m through 2,000 m depth. Unlike manganese nodules, they do not become deposited over a large area of the deep sea bottom but lie on relatively restricted areas. As their ore density is extremely high, mining crust deposits require a unique technique which can effectively mine ores within a narrow area. The device and method according to this invention improve the conventional continuous mining device for crusts for better practical use and provide a method for using the device with optimal efficiency.

(b) Description of the Prior Art

The experiment conducted by the present inventors in 1972 at the depth of 4,900 m in the waters south-east of Hawaii with the ship Daini Kyokuyo Maru (17,000 t) was the first mining experiment for the deep sea metallic nodules. The test was conducted on the method of mining by using one-ship sideward towing system which is shown in FIG. 6. The system attempts to prevent a rope from becoming entangled as their ends are separated. CNEXO of France proposed the two ship headward towing system which is shown in FIG. 7. The method attempts to prevent tanglement of a rope by positioning the two ships apart from each other by an appropriate distance. These systems were proposed to overcome the problem of rope tanglement encountered in the test using the Daini Kyokuyo Maru.

The present inventors conducted another test on the one ship headward towing system shown in FIG. 8 in the waters off the Bonin Islands in 1975. This system attempted to separate both ends of a rope from each other with hydrodynamic drag force applied on separator boards attached to the rope while the ship is being driven in the direction of the bow at an extremely slow speed. In FIGS. 6, 7, and 8, the letter S denotes a ship, the arrow marks the direction of movement of the ship, 4 a rope, and B buckets. The letter P denotes a board for separting ends of a rope with hydrodynamic drag force. The inventors filed a patent application for a continuous mining device for crust deposits in Japan on Oct. 12, 1985 as Japanese Patent Application Number 60 - 225973. The application was based fundamentally upon the device which realizes the above three systems.

In the test conducted in the summer of 1972 in the waters off the Hawaiian Islands with the Daini Kyokuyo Maru, crust deposits on the seamounts were actually mined by the continuous method of one ship sideward towing method shown in FIG. 6.

The crust was mined continuously from the foot of a seamount in the depth of ca. 4,800 m for about 120 buckets. The test proved that the continuous line bucket method was more suitable for crust deposit mining from the seamounts or other rugged sea bottoms than the suction pump mining method. In this test, we experienced rope tanglement about 3 times, and so how to prevent rope tanglement became the most important problem for continuous line bucket. The two ship headward towing system in FIG. 7 and one ship headward towing system in FIG. 8 were invented by France CNEXO and us after the Hawaii test.

This history of development of continuous line bucket mining was reported by Masuda at Hiro Hawaii conference which related the beginning of deep sea mining. The above three methods, however, were found with the following defects respectively.

In the one ship sideward towing system, a power device such as a side thruster must additionally be mounted on the mining ship for moving the ship sideward. This thereby pushes up the costs of the device, as well as the fuel costs for power. Towing a ship sideward is a difficult operation especially above the deposits near the seamounts where the deposit area is narrow.

As the two ship headward towing system needs two ships, communications and coordinated operation are difficult, thereby creating problems in the mining operation. Further, the costs of the mining operation inevitably increase as the system requires two ships.

The third system or the one ship headward towing system seems most feasible, but according to the prior art system, it requires a number of separation boards which act as separators attached on a rope at an interval. The attaching/detaching operation of such boards should be conducted continuously during the mining operation and thus proves too much trouble to employ during offshore operation.

Though all of these three systems may be adapted as a method for continuous mining device for crust deposits, there has been keenly felt a necessity to urgently develop an improved arrangement which is safer and more economical, and which is practically feasible.

Unlike manganese nodules, crust deposits lie in small and narrow areas in the limited seamounts where the ocean currents and conditions thereon constantly undergo complicated variations. In order to operate a ship over such area, the method should fully satisfy the condition that the operation be simple, and also it must prevent rope tanglement to separate two rope lines by some method.

SUMMARY OF THE INVENTION

This invention employs the following method in order to solve the problems encountered in the above continuous mining methods with buckets. Firstly, instead of utilizing the length of a ship or the distance between two ships of the prior art, and instead of separating the ends of a rope with hydrodynamic drag force devices, this invention tries to widely separate the rope line of the pulling up side from the line of the paying out side of an endless rope by mounted rope guide wheels at optimal positions on a single ship and by making the mining ship turn with the bow of the ship in the direction of the pulling up side.

Secondly, the present inventors studied theoretically as well as experimentally the optimal position of the guide wheel for the endless rope in the pulling up side, or in other words, at what distance from the bow the guide wheel or pully should be positioned in order to be closest to the center of rotation of the ship, and came to a conclusion that the optimal position of the guide wheel should be at a position on the side of the ship spaced from the bow by approximately two thirds of the length of the ship and which is proximate to the center of gravity or of turning of the ship. It will be understood that these points are generally proximate to one another.

It was found that the guide wheel on the paying out side should be positioned at the other side or at the stern of the ship. In this manner, the buckets attached on the rope line on the paying ou side are distributed on the sea bottom in an arc during the turning movement of the ship. As the high tension on the pulling up side of the rope line is applied from the position on the ship near the center of gravity or from the position spaced from the bow and on the side at about two thirds of the ship's length, the last bucket positioned in the arc on the sea bottom is applied substantially linearly with the pulling up force of the ship. As a result, the buckets are dragged on the sea bottom while they receive strong tension, scrape the sea bottom to collect sufficient crusts, leave the sea bottom and sequentially are pulled up linearly if viewed from above and in catenary when viewed from side.

Thirdly, this invention provides a long rope in the form of a loop, a large number of dredge buckets attached on the rope, a guide wheel for the pulling up line, a guide wheel for the paying out line, a driving device, a bucket releasing device, and a bucket mounting device and is positioned to satisfy the above two requirements for the ship.

BRIEF DESCRIPTION OF THE DRAWINGS

FIG. 6 is a perspective view of the prior art one ship sideward towing system, FIG. 7 a perspective view of the prior art two ship headward towing system, and FIG. 8 a perspective view of the prior art one ship headward towing system with drag plates for separation.

Figure 1:
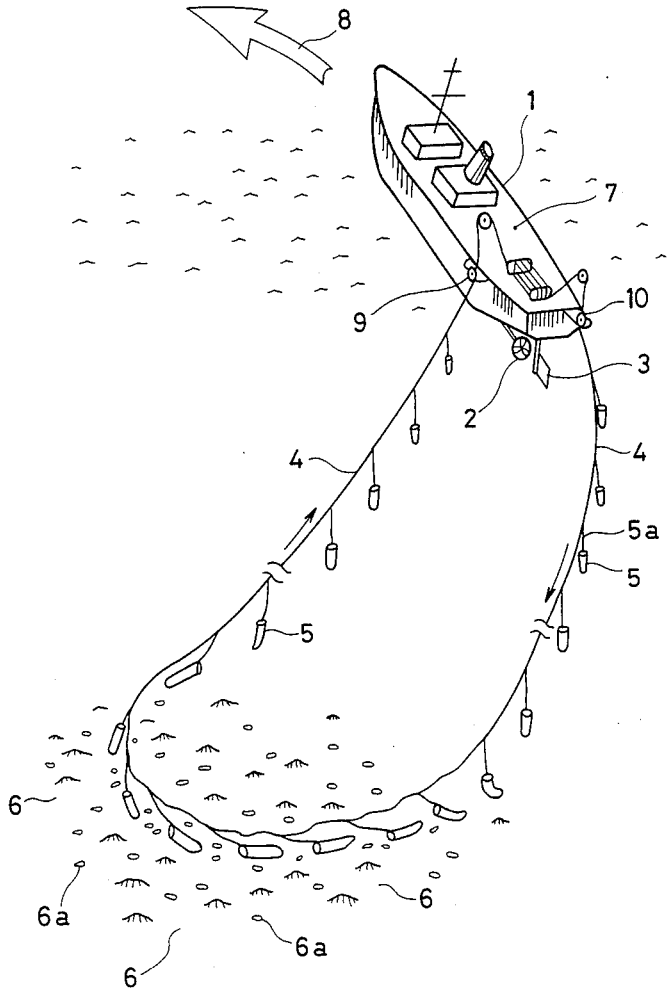
FIG. 1 is a perspective view to show an embodiment of this invention.

In the figures, the reference numeral 1 denotes a mining ship, 2 a controllable pitch propeller, 3 a rudder, 4 an endless rope, 5 dredge buckets, 5*a* a long suspension rope, 6 a bottom of a seamount, 6*a* a crust deposit, 7 the center of gravity of the mining ship, 8 the course of the ship, 9 a guide wheel on the pulling up side, 10 a guide wheel on the paying out side, the letter X the furrow of the lowering side rope line, the letter Y the rope line on the raising side, 11 a metal base support, 12 a metal arch, 13 a guide wheel on the ship, 14 a drum for multiple coiling, 15 another drum for multiple coiling, 16 a metal detachable connector, 17 a metal hook, 18 a cable, and 19 a pully. The same numerals denote the same or similar elements.

DESCRIPTION OF THE PREFERRED EMBODIMENTS

This invention will now be described in more detail referring to an embodiment shown in the attached drawings. FIG. 1 is a perspective view to schematically show an embodiment of this invention wherein a mining ship 1 is a large sized ship having a sufficient crust loadage. The ship should have a length of 150 m and total tonnage capacity of 15,000 ton. The mining performance of the ship should have a capacity of mining crusts at the rate of over 400 ton/day from a crust deposit at 1,200 m depth. The mining ship 1 is equipped with a controllable pitch propeller 2, and a rudder 3, by which the ship advances, and simultaneously steers and turns at the bow. A long endless rope 4 shown in the figure is attached with a large number of dredge buckets 5 at an interval via suspension ropes 5*a* respectively. The rope 4 itself forms a loop which is thrown into the water above a seamount 6.

The crust deposit 6*a* on the surface of a seamount generallly lies at a depth of 800 through 2,000 m. The rope 4 of the pulling-up side is very likely to entangle with the paying out side thereof somewhat in the sea. If the ship 1 is assumed to advance straight at a low speed, the pulling up side of the rope comes to be substantially parallel to the paying out side thereof. It is well known that the distance between both lines should preferably be at least about 1/20 to 1/40 of the water depth in order to minimize or prevent entanglement of the rope. The one ship sideward towing system mentioned above could achieve such arrangement, but the cost for ship maneuvering increases unavoidably.

Figure 2:
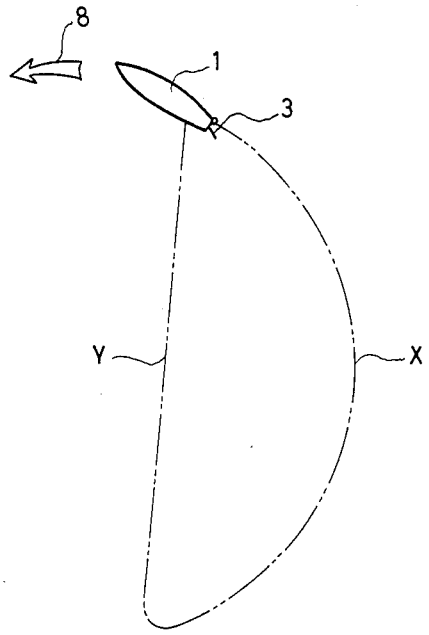
FIG. 2 a plane furrow chart.

When the mining ship 1 is steered with the rudder 3 to advance in the course shown by the arrow mark 8 in FIG. 1 by rotating the controllable pitch propeller 2, the wake or water furrow of the ship forms an arc shown by the letter X in FIG. 2. If a rope with buckets is paid out in the water from the mining ship 1 at a speed equal to or slightly faster than the speed of the ship, and is pulled up onto the other side at the same speed, the line X on the paying out side goes down under the water to reach the sea bottom along the wake of the ship, and when pulled with the pulling up side of the rope Y, is recovered into the ship by the pulling up device thereof with a tension equal to the sum of its weight and frictional resistance. FIG. 2 shows that the rope line X on the paying out side is lowered into the water in an arc in the direction tangent to the furrow of the ship while the rope line Y of the pullng up side traces substantially a straight line toward the direction of the pulling-up point on the ship which is moving as indicated. This keeps the two rope lines on both sides apart at an angle instead of being parallel to each other to safely prevent the two rope lines from tangling with each other. In this manner, this invention achieves the purpose of preventing two lines from tangling each other without attaching drag plates for separation on the ropes which were heretofore needed in the prior art one ship headward towing system.

Figure 3:
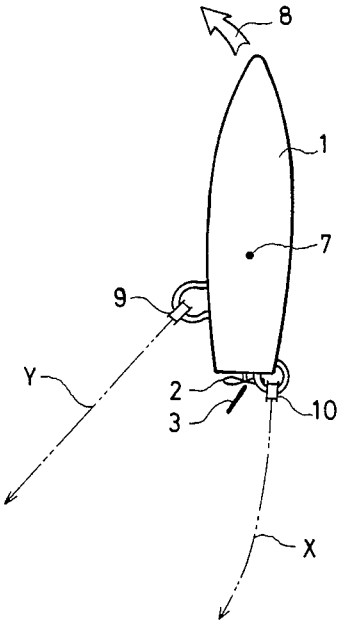
FIG. 3 a plane view to show the relation between a mining ship and the two positions for attaching a rope on the pulling up side and on the paying out side, and FIG. 4 a perspective view to show the essential mechanism of the device on the pulling up side, FIGS. 5(*a*) and 5(*b*) show respectively a furrow perspective chart when the ship turns around on the flat portion of the bottom of a seamount, and a plane view thereof.

The mining ship can be turned toward the direction of its bow by rotating the controllable pitch propeller 2 mounted on the ship 1 as shown in FIG. 3 and by manipulating the rudder 3 while moving the ship ahead so that the ship starts its turning movement with its rotational center on the gravity center 7 of the ship as shown with the arrow mark 8.

Among the counterforces against such turning movement, the force applied by the rope Y on the pulling up side is predominant. When the mining of 400 ton per day is scheduled, the tension from the rope will become as large as 20 to 30 tons.

The ship should overcome this force in order to move ahead. The influence on the maneuverability of the ship by such a force can be minimized when the direction of the force is made to pass through the center of the gravity or of turning 7 of the ship.

According to this invention, this is facilitated by postioning the guide wheel 9 for pulling up the rope at the side of the ship at about 2/3 of the ship's length from the bow.

Figure 4:
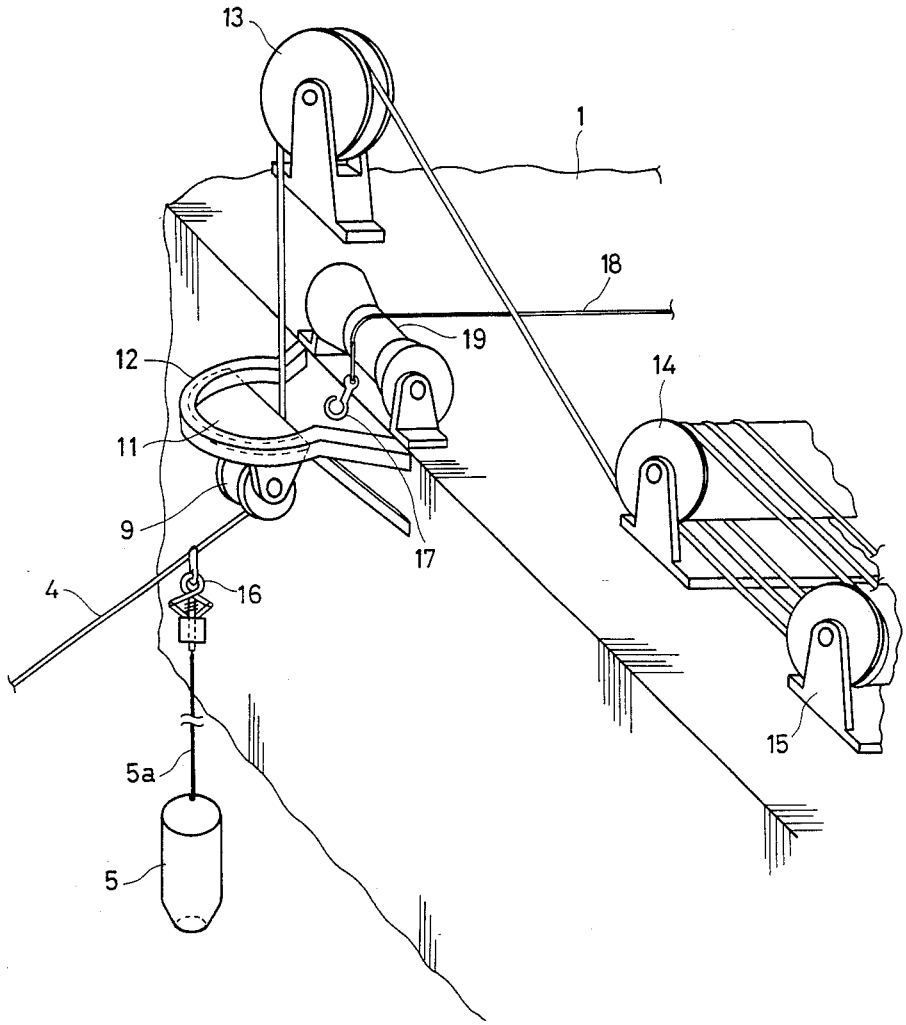

The guide wheel 9 is mounted on a metal base 11 supported as shown in the perspective view of the essential parts in FIG. 4, and the rope is slidably directed by the wheel 9 through the metal arch 12 toward the direction of the pulling up wheels 13 and 14. The position is selected so that the direction of the force by the rope is oriented to pass in the proximity of the gravity center of the mining ship 1 as previously discussed.

The rope 4 on the paying out side is paid out to be lowered into the sea from a guide wheel 10 mounted at the stern of the ship. An arrangement similar to that shown in FIG. 4 can be employed. As the force applied on the rope on the paying out side is small, there is no need to provide special consideration for the direction of the force as in the case of the pulling up side guide wheel.

Buckets 5 which have been recovered on the ship after collecting the crusts from the sea bottom are detached from the rope as it is being pulled in rope by using the detachable connector 16. The connector may be transferred to the hook 17, pulled up onto the ship with a wheel 19 and the cable 18, the crust therein removed, and then attached on the rope 4 again on the paying out side 10. The rope is moved by multiple cable drum 14, 15 on the ship as shown in FIGS. 1 and 4.

Figure 5A:
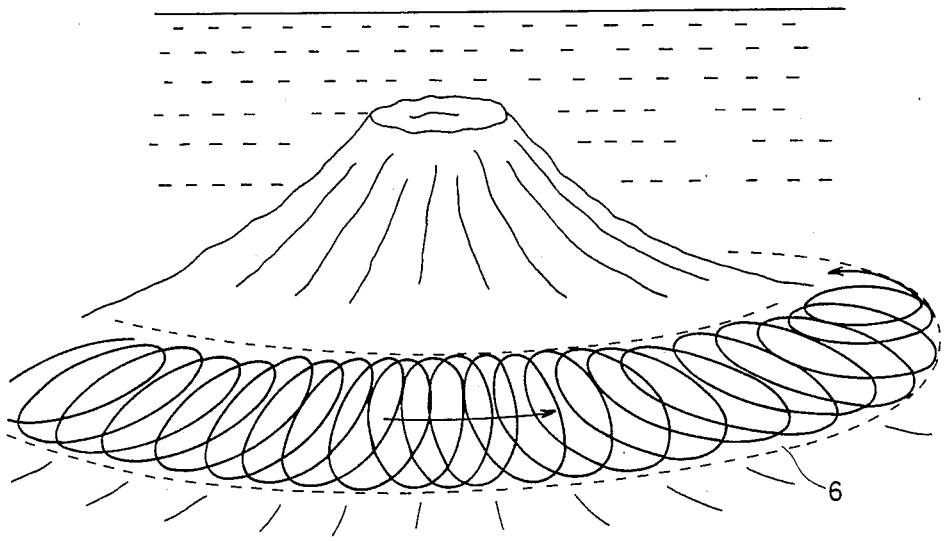
Figure 5B:
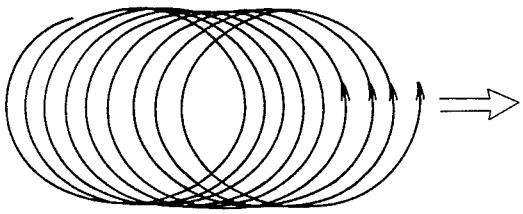

FIG. 5(*a*) shows the effect of the continuous mining device for crust deposits and the mining method by turning the ship which mounts such device. This invention device and method are effective in mining the crust deposits effectively even if the deposits lie in a narrow area like the area of 2 km $\times$ 10 km near a seamount as shown in FIG. 5(*a*) as this invention device can dredge out the sea bottom effectively at a high density while moving ahead as shown in FIG. 5(*b*). Such an effective mining comprises a remarkable aspect of this invention which has not been realized by the prior art continuous line bucket methods.

The maneuverability of the ship according to the invention is improved from the three conventional systems by positioning the pulling up side guide wheel at an optimal location on the ship so that the mining ship can be steered to readily meet changes in the ocean currents and conditions near the seamounts for effective mining in a small area. The arrangement of this invention device has another advantage in that it does not require drag plates which heretofore have presented a difficulty in handling. Employment of the mining method of this invention will achieve the highest economic effect in mining.

What is claimed is:

1. A method for mining crust deposits and the like located underwater with a maneuverable sea vessel of the type having a bow, a stern, port and starboard sides, an endless cable means of a selected length, means for engaging a portion of said cable means for moving said cable means to pay out and pull in said cable means, a plurality of bucket means attachable to said cable means at spaced intervals, at least two guide means for said cable means, said guide means being mountable on the vessel at spaced locations, one of said locations being disposed along one of the sides of the vessel, the other of the locations being at a location including one of the stern and the other side of the vessel, comprising the steps of:

a. moving the vessel while turning through an arc of between 180° and 360° to one side of the vessel;

b. paying out the cable means from one location including one of the stern and the other side of the vessel with the bucket means attached at said spaced intervals, the length of the cable means paid out being such that at least a portion of the bucket means of the cable means will engage the crust deposits;

c. simultaneously pulling in the cable means with the bucket means on said one side of the vessel which is located on the inside of said arc;

d. maintaining the cable means being paid out from the one location separate from the length of cable means being pulled in and being generally in a straight line while the cable means being paid out traces generally an arc.

2. The method as claimed in claim 1 including the step of pulling in the cable means at a location along the side of the vessel that is adjacent the center of turning of the vessel.

3. Apparatus for the mining of crust deposits located underwater with a maneuverable sea vessel having a bow, a stern, port and starboard sides, the apparatus comprising an endless cable means of a selected length, means for engaging a portion of said cable means for moving said cable means to pay out and pull in said cable means, a plurality of bucket means attached to said cable means at spaced intervals, at least two guide means for said cable means, said guide means being mounted on the vessel at spaced locations, one of said locations being disposed along one of the sides of the vessel at approximately two thirds of the length of the vessel measured from the bow of the vessel, the other of the locations being on the other side of the vesel with said one location being used to pull in said cable means and the other location being used for paying out the cable means.

4. Apparatus for the mining of crust deposits located underwater with a maneuverable sea vessel having a bow, a stern, port and starboard sides, the apparatus comprising an endless cable means of a selected length, means for engaging a portion of said cable means for moving said cable means to pay out and pull in said cable means, a plurality of bucket means attached to said cable means at spaced intervals, at least two guide means for said cable means, said guide means being mounted on the vessel at spaced locations, one of said locations being disposed along one of the sides of the vessel at approximately two thirds of the length of the vessel measured from the bow of the vessel, the other of the locations being on the stern of the vessel with said one location being used to pull in said cable means and the other location being used for paying out the cable means.

5. The invention as claimed in claim 3, wherein means for detachably securing said bucket means to said cable means are provided.

6. The invention as claimed in claim 4, wherein means for detachably securing said bucket means to said cable means are provided.

7. The invention as claimed in claim 3, wherein said apparatus includes a sea vessel having propelling means, said propelling means including a variable pitch propeller, said vessel further including steering means including a rudder operable for low speed turning navigation.

* * * * *